US005769744A

United States Patent [19]

Merrill et al.

[11] Patent Number: 5,769,744

[45] Date of Patent: Jun. 23, 1998

[54] TABLE TENNIS NET MOUNTING ASSEMBLY

[75] Inventors: Glenn Merrill, Ogden; Carl Stanford, Clinton, both of Utah

[73] Assignee: Lifetime Products, Inc., Clearfied, Utah

[21] Appl. No.: 595,717

[22] Filed: Feb. 2, 1996

[51] Int. Cl.[6] ..... A63B 39/00

[52] U.S. Cl. ..... 473/493

[58] Field of Search ..... 473/459, 475, 473/491, 492, 493, 494, 495, 496

[56] References Cited

U.S. PATENT DOCUMENTS

| | | | |
|---|---|---|---|
| 2,569,007 | 9/1951 | Klyce | 311/89 |
| 2,931,650 | 4/1960 | Hine | 473/475 |
| 2,991,139 | 7/1961 | Fihe | 311/92 |
| 3,062,544 | 11/1962 | Viets | 273/30 |
| 3,078,094 | 2/1963 | Goodenough | 273/30 |
| 3,190,649 | 6/1965 | Heisler | 273/30 |
| 3,703,287 | 11/1972 | Smith et al. | 273/30 |
| 3,754,760 | 8/1973 | Nielsen | 473/475 |
| 3,773,323 | 12/1973 | Parsons | 108/113 |
| 3,777,674 | 12/1973 | Parsons | 108/113 |
| 4,762,321 | 8/1988 | Chang | 273/30 |
| 4,911,085 | 3/1990 | Pencoske | 108/114 |
| 5,375,837 | 12/1994 | Moreau | 237/30 |

FOREIGN PATENT DOCUMENTS

| | | | |
|---|---|---|---|
| 1473327 | 3/1967 | France . | |
| 1487425 | 9/1977 | United Kingdom | A63B 67/04 |

OTHER PUBLICATIONS

Harvard Sports, "Harvard Table Tennis," Product Brochure, pp. 4–8, 18–19.

The Detroiter Division of Michigan Ladder Co., "Tournament—Institutional Tables," Product Brochure (date unknown).

Indian Industries Inc., "Stiga Privat Roller," Owner's Manual (1993).

*Primary Examiner*—Theatrice Brown

*Attorney, Agent, or Firm*—Madson & Metcalf

[57] ABSTRACT

A net mounting assembly for use in playing the game of table tennis is disclosed. The net mounting assembly comprises a pair of net brackets with each net bracket including a net post to which a standard table tennis net may be secured. Each net bracket also includes an extension arm which is pivotally mounted to the net post. A stop is provided for preventing the net post from pivoting beyond a position substantially perpendicular to the table tops. Also included is an attachment assembly which corresponds to each net bracket. The attachment assembly secures the corresponding net bracket while permitting the net bracket to pivot relative to the table. The attachment assembly is further configured to slidably engage the extension arm, thereby permitting the tension of the net to be adjusted and the extension arm to thereafter be secured in place. The net assembly is permanently secured to the bottom of one table top of a collapsible table and enables the table to be collapsed without interference from the net assembly.

30 Claims, 5 Drawing Sheets

TABLE TENNIS NET MOUNTING ASSEMBLY

BACKGROUND

1. The Field of the Invention

The present invention is related to a net mounting assembly for securing a net above a table for use in playing the game of table tennis. More particularly, the present invention is related to a net mounting assembly which permanently mounts to one side of a two-piece collapsible table, breaks away in response to a lateral force, and folds up against the table to enable the net to lie against the table when the table is collapsed for storage.

2. Technical Background

The game of table tennis is popular in the United States and in many other countries throughout the world. The use of collapsible table configurations for making table tennis tables enables the game to be enjoyed in locations where space is at a premium. When the table is no longer needed, it can be collapsed and placed against a wall or in another storage location while occupying a minimum of space. One such table configuration is disclosed and claimed in U.S. Pat. Nos. 4,911,085 and 5,119,741 invented by Edward L. Pencoske and entitled "Collapsible Table."

One problem frequently encountered in table tennis equipment is that the net mounting assemblies which are typically employed on such tables easily become damaged and/or misplaced. Typical of net assembly designs is one popular design which is configured in the shape of a C-clamp and may be mounted onto the table once the table is assembled into a playing position. Because the net assembly must be detached from the table when the table is stored, it may easily be misplaced, thereby rendering the entire table tennis assembly inoperable.

Attempting to leave the net assembly attached to one side of the table top during storage gives rise to a variety of problems. On regulation table tennis tables, the net must extend six inches beyond the edge of the table on each side. Thus, keeping the net secured to the table with such an overhang significantly increases the amount of space needed to accommodate storage of the table. Additionally, the net must generally be removed when the table is collapsed, causing the net to be separated from the table during storage.

Another difficulty which often arises when using such net mounting assemblies is that they cannot be successfully be utilized with nets of various sizes. While a six-inch extension beyond the table top is generally desirable, in some instances it may be preferable to use a net which provides for less of an overhang.

Finally, because of the amount the net mounting mechanism extends beyond the edge of the table, it is often subject to being hit, such as by people walking next to the table. These lateral forces applied to the net mounting assembly will often damage the net mounting assembly or the table to which it is attached, or both.

Hence, it will be appreciated that it would be an advancement in the art to provide a net mounting assembly which could be permanently mounted to a table tennis table, particularly a table having a collapsible configuration. Indeed, it would be advantageous if such a net mounting assembly could be provided which would not require removal of the net for storage of the table.

It would be a further advancement in the art if such a net mounting assembly could be provided which would readily adjust to various sizes of net and permit various amounts of net overhang relative to the edge of the table.

It would be an additional advancement in the art if such a net mounting assembly would withstand the application of lateral forces while protecting the table from damage in response to such forces.

Such a net mounting assembly is disclosed and claimed herein.

BRIEF SUMMARY AND OBJECTS OF THE INVENTION

The present invention is directed to a novel net mounting assembly for use in playing the game of table tennis. The net mounting assembly of the present invention is preferably used with a collapsible table including a first and a second table top and configured such that the table tops are pivotally mounted for movement between a storage position in which the table tops are positioned in a substantially vertical disposition, and a playing position in which the table tops are positioned contiguous to each other in a substantially horizontal disposition.

The net mounting assembly comprises a pair of net brackets with each net bracket including a net post to which a standard table tennis net may be secured. Each net bracket also includes an extension arm which is pivotally mounted to the net post. A stop is provided for preventing the net post from pivoting beyond a position substantially perpendicular to the table tops.

In most instances, the net mounting assembly will be configured such that the extension arm is positioned parallel to the table top; thus, the net post may pivot between a position substantially perpendicular to the table top (and the extension arm) and a position substantially parallel with the table tops (and substantially collinear with the extension arm).

The net mounting assembly also includes an attachment assembly which corresponds to each net bracket. The attachment assembly is configured to secure the corresponding net bracket while permitting the net bracket to pivot relative to the table. Thus, in response to a sufficient lateral force applied to the net bracket, the net bracket may pivot, thereby preventing the lateral force from damaging the net mounting assembly. The attachment assembly is further configured to slidably engage the extension arm, thereby permitting the tension of the net to be adjusted and the extension arm to thereafter be secured in place.

Each attachment assembly also includes a mounting bracket which is permanently secured to the table. In a preferred embodiment, the mounting brackets are permanently secured to the bottom surface of the first table top. Each mounting bracket includes a substantially flat plate upon which the corresponding net bracket may rotate in response to the lateral force.

When the table is in the playing position, a substantially continuous joint is defined between the two table tops. Thus, the extension arms are configured in a curvilinear shape such that each net post may be positioned in line with the continuous joint, thereby centering the net between the two table tops.

When the table is in the playing position, the two table tops define a lateral edge extending along the length of each side of the table. The extension arms are sufficiently long to permit the corresponding net posts to be positioned at least six inches beyond the lateral edge of the table, thereby complying with standardized parameters for table tennis tables.

The attachment assembly comprises a threaded pivot pin extending outwardly from the mounting bracket. A wing nut is also provided for threadably engaging the pivot pin. The extension arm is configured to engage the pivot pin and be secured in place by tightening the wing nut onto the pivot pin.

In one embodiment, each extension arm is configured with a slotted channel which engages the pivot pin. In an alternative embodiment, the extension arms are made of square tubing and the corresponding attachment assembly comprises a pair of retaining brackets which are configured to clamp onto the extension arm.

Objects and advantages of the present invention will become more fully apparent by examination of the following description of the preferred embodiments and the accompanying drawings.

BRIEF DESCRIPTION OF THE DRAWINGS

A more particular description of the invention briefly described above will be rendered by reference to the appended drawings. Understanding that these drawings only provide information concerning typical embodiments of the invention and are not therefore to be considered limiting of its scope, the invention will be described and explained with additional specificity and detail through the use of the accompanying drawings, in which.

DETAILED DESCRIPTION OF THE PREFERRED EMBODIMENTS

Figure 1:
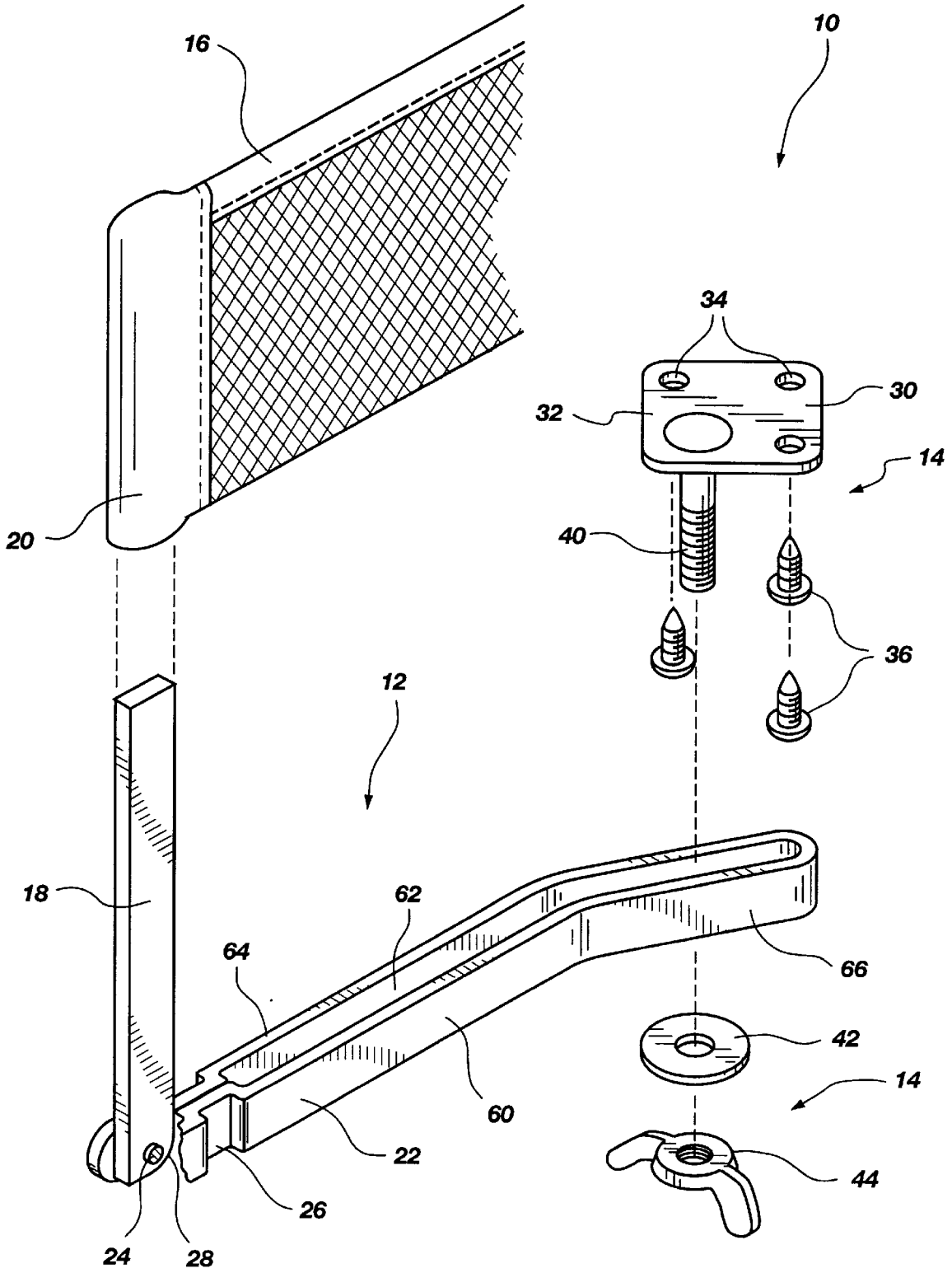
FIG. 1 is an exploded view of one embodiment of the net mounting assembly of the present invention.

Reference is now made to the figures wherein like parts are referred to by like numerals throughout. With particular reference to FIG. 1, a net mounting assembly according to the present invention is generally designated at 10. The net mounting assembly 10 includes a pair of net brackets 12 and an attachment assembly 14 corresponding to each net bracket 12. It will be appreciated that a single net bracket 12 and attachment assembly 14 are positioned on each side of a table tennis table for securing a net 16 in a playing position over the table. Thus, for ease of illustration, only one net bracket 12 and attachment 14 are generally described herein.

The net bracket 12 includes a net post 18 to which the net 16 may be secured. The net post 18 may be configured as illustrated to permit a pocket 20 in the net to slip onto the net post 18. Alternatively, the net post 18 may include attachment apertures, such as is known in the art, for securing nets having tie strings at their ends. Preferably, the net post 18 is configured such that when the net assembly is mounted on a table tennis table, the top of the net 16 is positioned six inches above the top surface of the table, according to the regulations of the United States Table Tennis Association.

Figure 3:
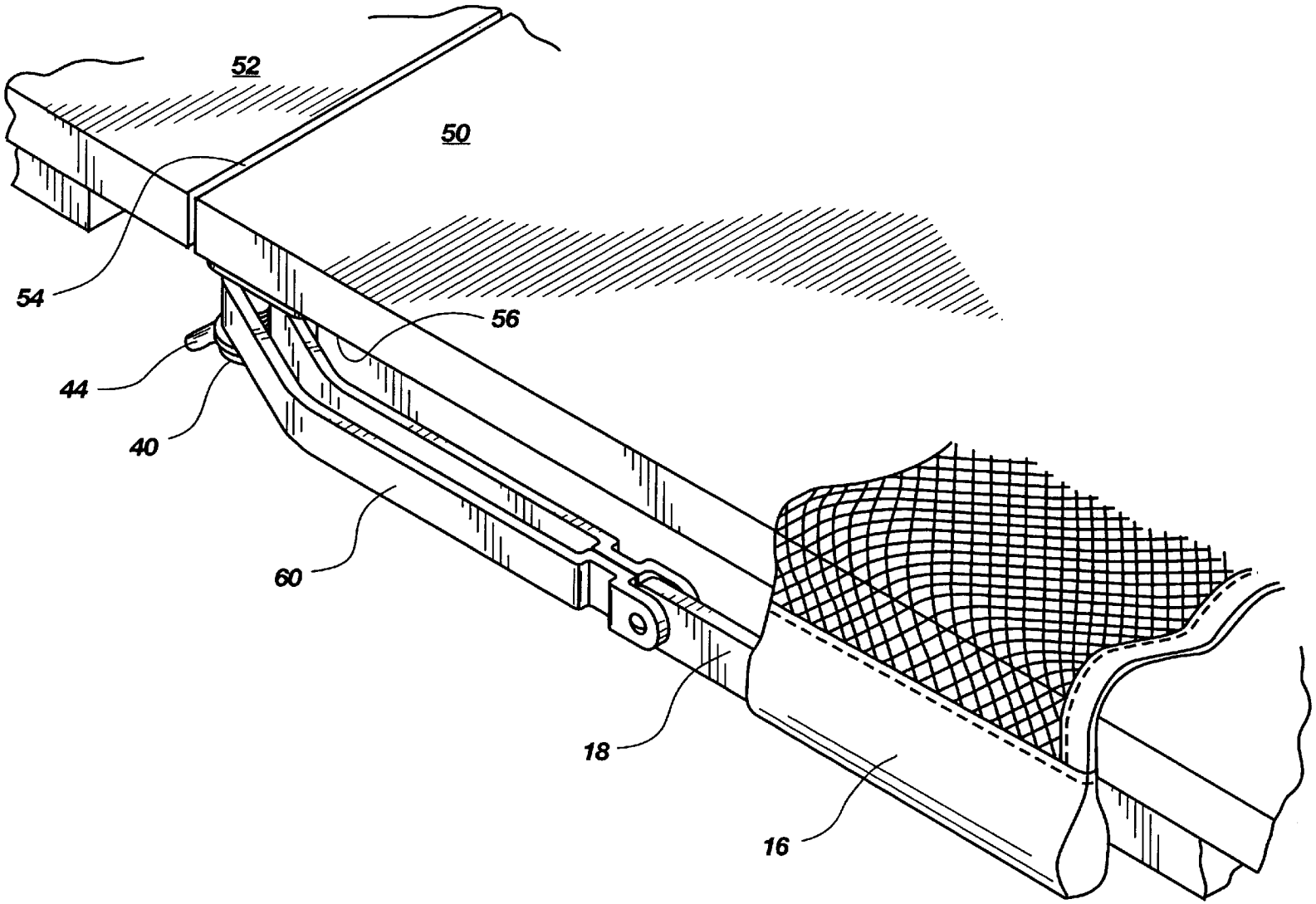
FIG. 3 is a perspective view of the embodiment of FIG. 1 shown in a storage position.

The net bracket 12 also includes an arm 22 pivotally mounted to the net post 18. The pivotal mount is accomplished through the use of a pivot pin 24. The net bracket 12 further comprises a stop for preventing the net post 18 from pivoting beyond a position substantially perpendicular to the arm 22. In this preferred embodiment, the stop comprises a pinched portion 26 of the arm 22. The leading edge 28 of the net post 18 is rounded, thereby enabling the pinched portion 26 to act as a stop for the net post 18 in the vertical position (FIG. 1) and in the horizontal position (FIG. 3). Thus, the net post 18 may pivot about the pivot pin 24 through 90 degrees.

With continued reference to FIG. 1, the attachment assembly 14 includes a mounting bracket 30 which comprises a substantially flat plate 32 configured with a plurality of holes 34 through which screws 36 may be inserted to permanently mount the mounting bracket 30 to the underside of the table top of a table tennis table.

The mounting bracket 30 is preferably "permanently" secured or mounted to the table, meaning that the mounting bracket 30 is secured without intention of removing it for purposes such as collapsing the table for storage, etc. This is preferably done through mounting means which are common for such a purpose, such as screws, bolts, etc. One advantage to permanently securing the mounting bracket 30 is that the table may be sold in a preassembled state, with the net assembly 10 attached to the table at the appropriate position.

The attachment assembly 14 also includes a pivot pin 40 extending outwardly from the mounting bracket 30. The pivot pin 40 is preferably configured with threads. A washer 42 and a wing nut 44 are also provided for engaging the pivot pin 40. Alternatively, a threaded hole could be provided in the mounting bracket with a winged thumb screw used to thread into the threaded hole.

While the net assembly 10 of the present invention may be utilized with a variety of table tennis tables, including tables having a one-piece or two-piece playing surface, the net assembly 10 is preferably utilized with tables having a two-piece playing surface which are configured to collapse to accommodate storage of the table. One preferred table design is that disclosed in U.S. Pat. Nos. 4,911,085 and 5,119,741, invented by Edward L. Pencoske and entitled "Collapsible Table," which disclosures are specifically incorporated herein by this reference.

As illustrated in FIG. 3, such tables include a first table top 50 and a second table top 52 which are pivotally mounted for movement between a storage position and a playing position. In the playing position illustrated in FIG. 3, the table tops are positioned contiguous to each other in a substantially horizontal disposition with a substantially continuous joint 54 being defined between the table tops. In the storage position, the table tops are positioned in a substantially vertical disposition, thereby taking up substantially less floor space than when in the playing position. As one of skill in the art will appreciate, many mechanical designs may be utilized to achieve such a collapsible table.

The net assembly 10 of the present invention is preferably attached to the table by permanently securing a mounting bracket 30 to the bottom surface 56 of the first table top 50. This may be done by inserting the screws 36 through the holes 34 of the mounting bracket and screwing the screws 36 into the table top 30 by affixing the screws directly into the layer which forms the playing surface, into a table top structural reinforcement, or into some other portion of the table top which is capable of firmly gripping the screws.

The arm 22 is then attached to the attachment assembly 14. In the preferred embodiment illustrated in FIGS. 1 through 3, the arm 22 comprises an extension arm 60 configured with a slotted channel 62 for receiving the pivot pin 40. The washer 42 and wing nut 44 can then be threaded onto the pivot pin.

Prior to tightening the wing nut 44, the extension arm may be extended to position the net post 18 at a predetermined location relative to the edge of the table top. The wing nut 44 is then tightened to secure the net bracket into this predetermined position. Preferably, the extension arm is positioned such that the net 16 extends six inches beyond the lateral edge of the table top, as dictated by the regulations of the United States Table Tennis Association.

At least one of the arms 22 should be configured as an extension arm 60, i.e., capable of variable positioning on the pivot pin 40 to enable the position of the net post 18 relative to the edge of the table to be controlled. Preferably, however, both arms 22 are configured as extension arms 60.

The extension arm 60 is preferably configured in a curvilinear shape, thereby enabling the net post 18 to be positioned in line with the continuous joint 54. In this preferred embodiment, the extension arm 60 includes a straight segment 64 and an angular segment 66. Thus, the pivot pin 40 can be positioned within the angular segment 66 at a location to accurately align the straight segment 64 of the extension arm 60 with the joint 54, thereby compensating for the off-center positioning of the mounting bracket 30.

Figure 2:
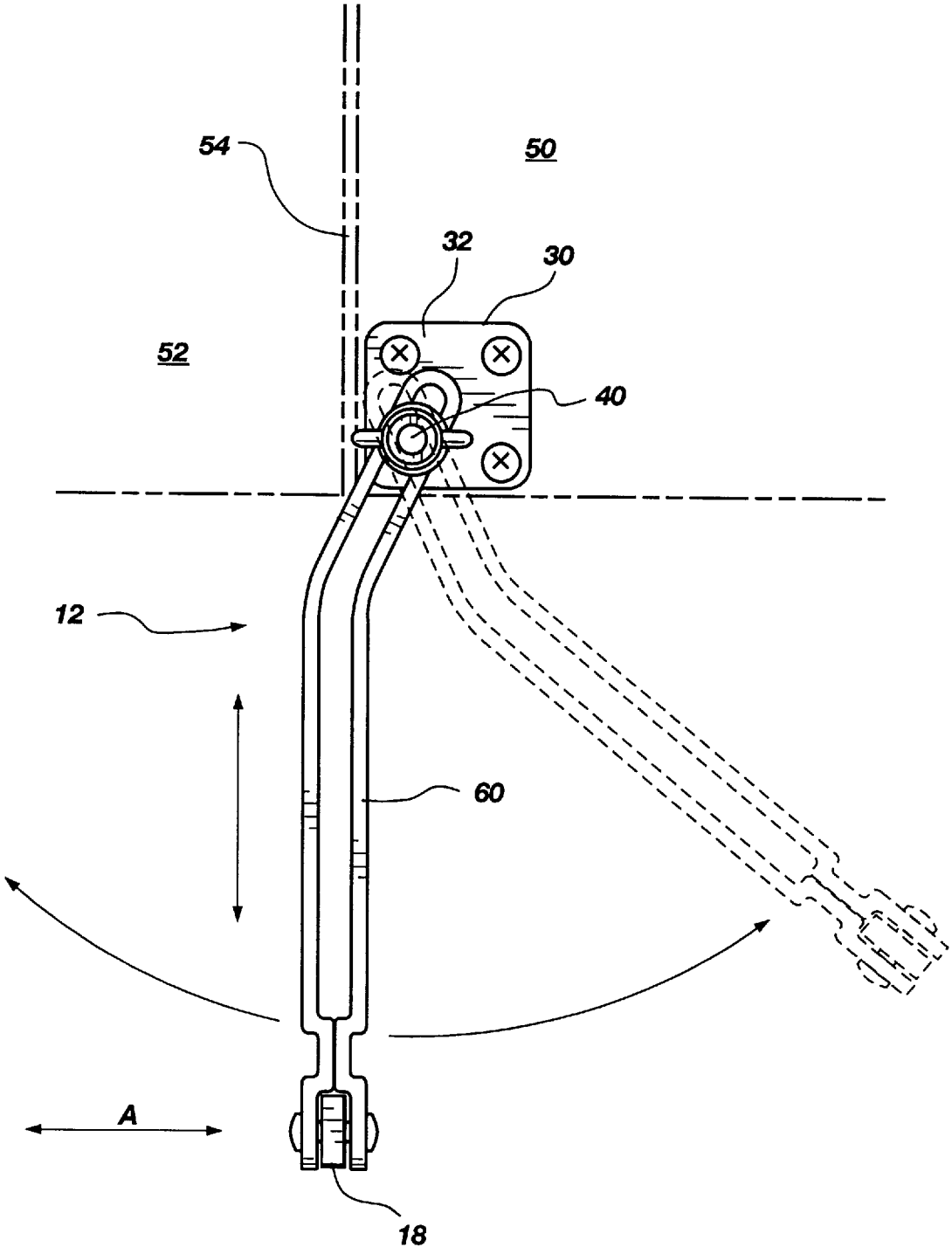
FIG. 2 is a top plan view of the embodiment of FIG. 1 mounted to a table tennis table.

Additionally, however, the net bracket 12 is capable of rotation about the pivot pin 40, as illustrated in FIG. 2. Thus, the net post 18 may be positioned at any position defined by the arc created by the net post about the pivot pin 40.

Importantly, the flat plate 32 on the mounting bracket 30 provides a surface upon which the net bracket 12 may rotate in response to the lateral force, even when the wing nut 44 has been tightened. If a lateral force, i.e., a force in the direction of arrow A, is applied to the net bracket 12, it can pivot about the pin 40, thereby preventing damage to the net assembly 10 or the table. Because of the significant amount the net post 18 extends beyond the edge of the table, people walking by the table may easily hit the net post 18, applying such a lateral force.

By utilizing a wing nut which is tightened by hand, most users of the present invention will not be able to tighten the wing nut 44 sufficient to prevent the net bracket 12 from pivoting about the pin 40 in response to a lateral force sufficient to deform the net assembly or damage the table. Thus, it is presently preferred that a wing nut 44 be employed to secure the net bracket 12 to the attachment assembly 14. As an alternative to the use of a wing nut 44, a friction lock or spring load lock could also be effectively employed.

As indicated above, the net post 18 can pivot about pivot pin 24. Generally, the net assembly 10 of the present invention is configured such that, when mounted to a table, the extension arm 60 is positioned parallel to the table top. Thus, the net post 18 may pivot between a position substantially perpendicular to the table top (and the extension arm 60), as illustrated in FIG. 2, and a position substantially parallel with the table top (and substantially collinear with the extension arm), as illustrated in FIG. 3.

One of the advantages of having both net attachment assemblies 14 mounted to the same table top 50 is that the net assembly 10 may be essentially folded against the side of the table for storage, as illustrated in FIG. 3. In such a storage position, the table top may be moved to a vertical disposition without interference of the net assembly, thereby avoiding the necessity of removing the net assembly while simultaneously preventing the net assembly from requiring additional space to store the table.

An additional advantage to having the net assembly 10 mounted to only one table top 50 is that the table may be placed in "play-back" mode without adjustment of the net assembly. Play-back mode is achieved by positioning the second table top 52 in a substantially vertical position while leaving the first table top 50 in the horizontal position. A player may then practice by hitting the ball off the wall formed by the second table top 52.

Figure 4:
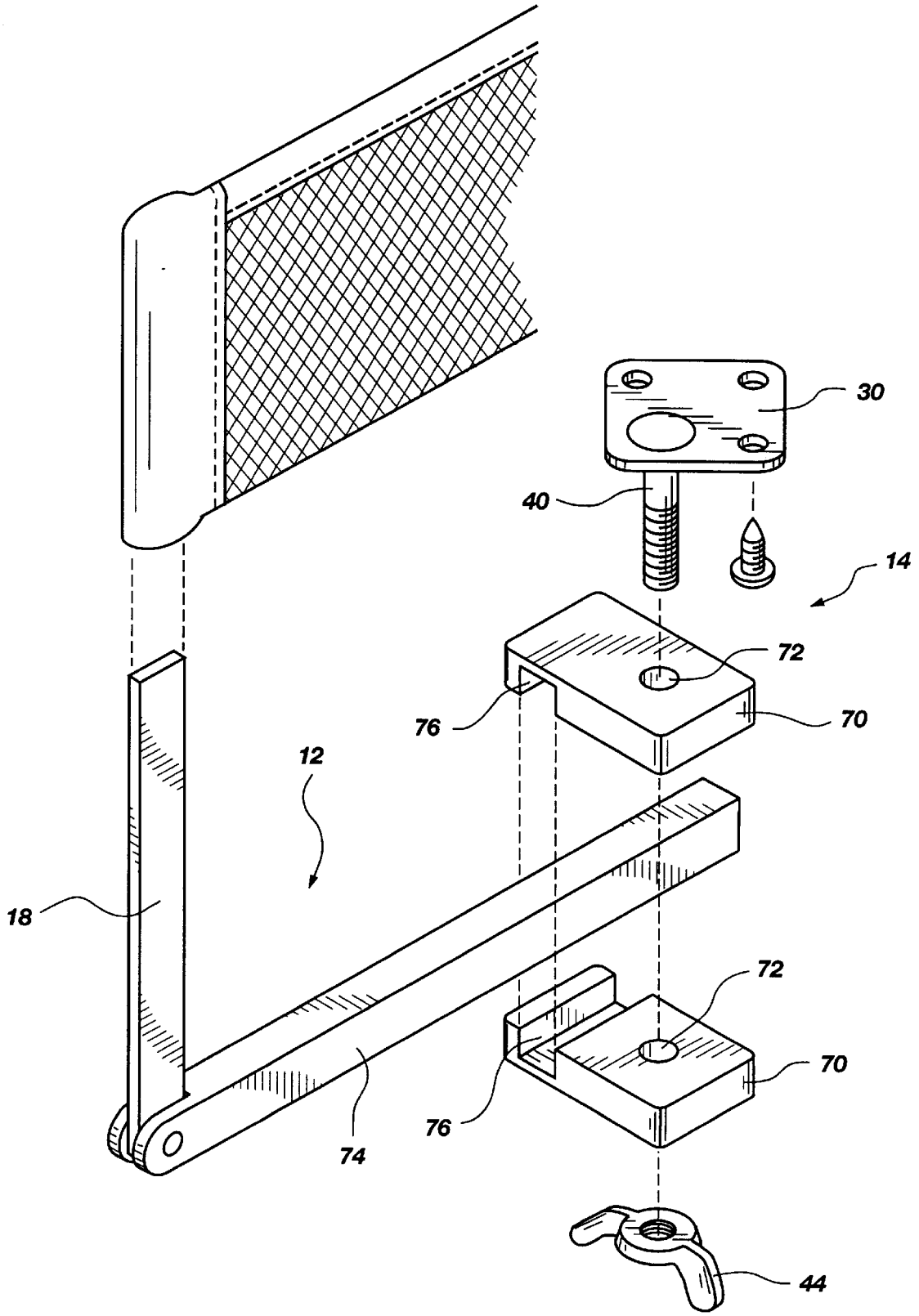
FIG. 4 is an exploded view of an alternative embodiment of the net mounting assembly of the present invention.

An alternative embodiment of the present invention is illustrated in FIG. 4. In this alternative embodiment, the attachment assembly 14 is configured with a pair of retaining brackets 70 including holes 72 through which the pivot pin 40 may be positioned. The extension arm 74 of the net bracket 12 is made out of square tubing, with correspondingly shaped clamp openings 76 which are configured to clamp onto the extension arm 74. It will be appreciated that, according to this embodiment of the present invention, a variety of geometrical shapes may utilized for the extension arm 74, so long as the clamp openings 76 are of a shape to matingly engage the extension arm 74.

This embodiment is attached to a table tennis table in substantially the same manner as the embodiment described in connection with FIGS. 1 through 3. The extension arm 74 may slidably engage the attachment assembly 14, thereby permitting the brackets 70 to engage the extension arm 74 at any point along its length. Additionally, this embodiment is also capable of pivotal movement about the pivot pin 40 in response to a lateral force applied to the net bracket. Finally, the net post 18 may also pivot between a position substantially perpendicular to the arm 74 and a position substantially collinear with the arm.

Figure 5:
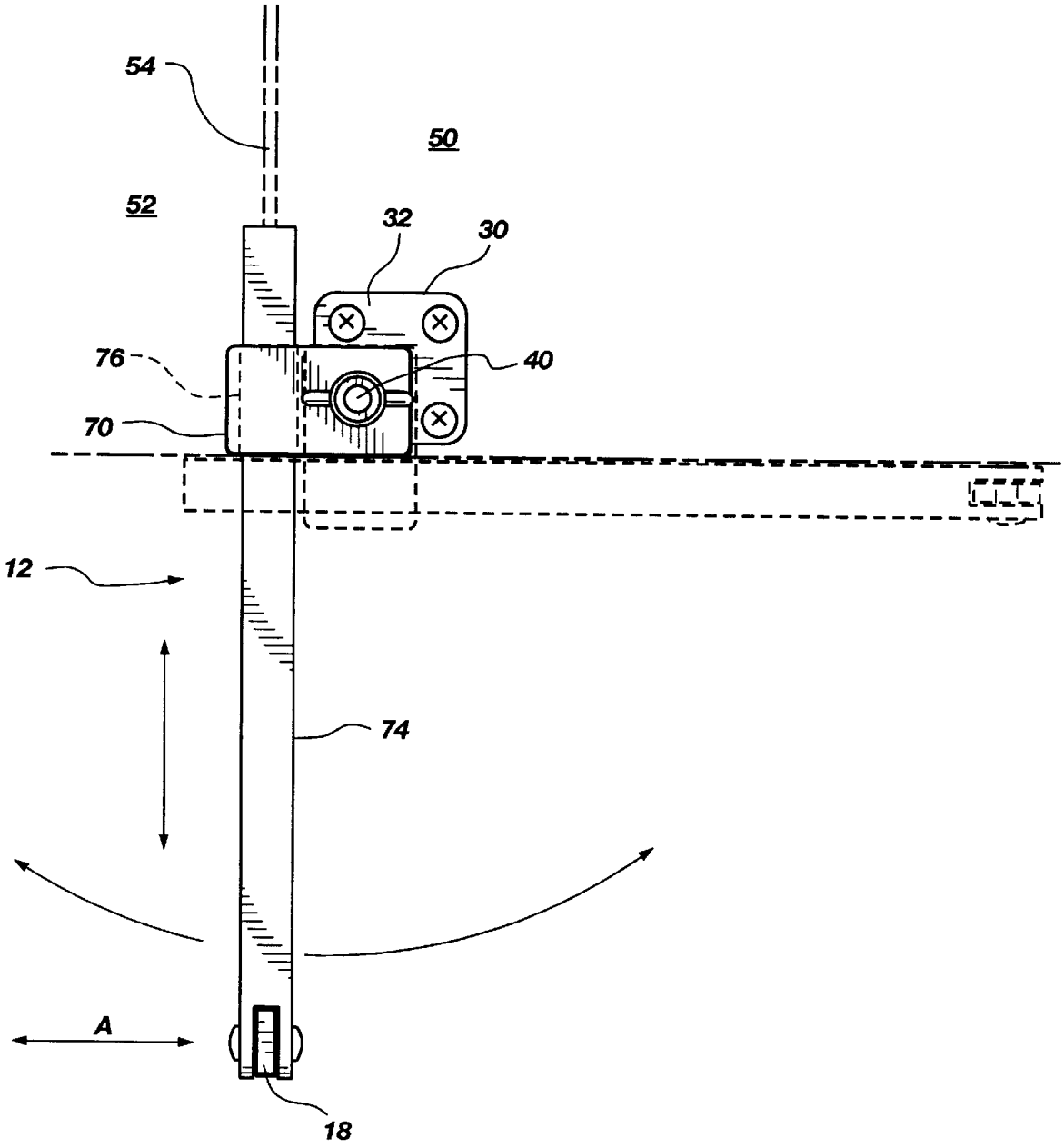
FIG. 5 is a top plan view of the embodiment of FIG. 4 mounted to a table tennis table.

As illustrated in FIG. 5, the arm 74 may be pivoted about the pivot pin 40 to be positioned substantially collinear with the joint 54 between the table tops. Hence, the tension of the net may be adjusted while preserving the arm 74 in line with the joint 54. Additionally, for table or net storage, the arm 74 may be pivoted 90 degrees to a position substantially flush with the edge of the table top (illustrated in phantom lines).

From the foregoing, it will be appreciated that the present invention provides a net mounting assembly which may be permanently mounted to a table tennis table, particularly a table having a collapsible configuration. Thus, the present invention does not require removal of the net for storage of the table.

The net mounting assembly of the present invention also permits easy adjustment to various sizes of net and permits various amounts of net overhang relative to the edge of the table. The net assembly of the present invention also withstands the application of lateral forces while protecting the table from damage in response to such forces.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A net mounting assembly for securing a net above a table for use in playing the game of table tennis, comprising:

a pair of net brackets, each net bracket comprisng;

a net post for selectively securing the net, and an arm pivotally mounted to the net post; and an attachment assembly corresponding to each net bracket and configured for pivotally securing the corresponding net bracket to the table enabling the net bracket to pivot in reponse to a sufficient lateral force applied in the net bracket, thereby preventing the lateral force from damaging the net mounting assembly, each attachment assembly including a mounting bracket which may be secured to the table.

2. A net mounting assembly as defined in claim 1, wherein each net bracket further comprises a stop for preventing its net post from pivoting beyond a position substantially perpendicular to its arm, thereby allowing the net post to pivot between a position substantially perpendicular to the arm and a position substantially collinear with the arm.

3. A net mounting assembly as defined in claim 1, further comprising means for permanently securing each mounting bracket to the table.

4. A net mounting assembly as defined in claim 1, wherein each mounting bracket includes a substantially flat plate upon which the corresponding net bracket may rotate in response to the lateral force.

5. A net mounting assembly as defined in claim 1, wherein said arm of at least one of the net brackets includes an extension arm, and wherein the corresonding attachment assembly is configured to slidably engage the extension arm, thereby permitting tension in the net to be adjusted and the extension arm to thereafter be secured in place.

6. A net mounting assembly as defined in claim 5, wherein each attachment assembly has a pivot pin extending outwardly from the mounting bracket and wherein each extension arm is configured with a slotted channel for slidably receiving the pivot pin.

7. A net mounting assembly as defined in claim 5, wherein each attachment assembly comprises a pair of retaining brackets configured to clamp the extension arm therebetween.

8. A net mounting assembly for securing a net above a table for use in playing the game of table tennis, comprising:

a pair of net brackets, each net bracket comprising, a net post for selectively securing the net, an arm pivotally mounted to the net post, at least one of the net brackets including an arm which comprises an extension arm, and a stop for preventing each net post from pivoting beyond a position substantially perpendicular to its corresponding arm, thereby allowing the net post to pivot between a position substantially perpendicular to the arm and a position substantially collinear with the arm; and an attachment assembly corresponding to each net bracket and configured for pivotally securing the corresponding net bracket to the table enabling the net bracket to pivot in response to a sufficient lateral force applied to the net bracket, thereby preventing the lateral force from damaging the net mounting assembly, the attachment assembly further configured to slidably engage the extension arm, thereby permitting tension in the net to be adjusted and the extension arm to thereafter be secured in place, each attachment assembly including a mounting bracket which may be permanently secured to the table.

9. A net mounting assembly as defined in claim 8, wherein each mounting bracket includes a substantially flat plate upon which the corresponding net bracket may pivot in response to the lateral force.

10. A net mounting assembly as defined in claim 8, wherein the arm on each net bracket comprises an extension arm and wherein each attachment assembly is configured to slidably engage the corresponding extension arm.

11. A net mounting assembly as defined in claim 10, wherein each attachment assembly comprises a pivot pin extending outwardly from the mounting bracket, and wherein each extension arm is configured with a slotted channel for slidably receiving the pivot pin.

12. A net mounting assembly as defined in claim 10, wherein each attachment assembly comprises a pair of retaining brackcets configured to clamp the corresponding extension arm therebetween.

13. A net mounting assembly as defined in claim 8, wherein each attachment assembly further comprises a threaded pivot pin and a wing nut threadably engaging the pivot pin.

14. A table and net mounting assembly for use in playing the game of table tennis, comprising:

a first and a second table top, the table tops being pivotally mounted for movement between a storage position in which the table tops are positioned in a substantially vertical disposition, and a playing position in which the table tops are positioned contiguous to each other in a substantially horizontal disposition;

a pair of net brackets, each net bracket comprising, a net post for selectively securing the net, an arm mounted to the net post, and a stop for preventing each net post from pivoting beyond a position substantially perpendicular to the table tops, thereby allowing the net post to pivot between a position substantially perpendicular to the table tops and a position substantially paallel with the table tops; and an attachment assembly corresponding to and securing each net bracket, the attachment assembly securing the corresponding net bracket to the table while permitting the net bracket to pivot relative to the table in response to a sufficient lateral force applied to the net bracket, thereby preventing the lateral force from damaging the net mounting assembly, the attachment assembly configured to slidably engage the extension and, thereby permitting tension in the net to be adjusted and the extension arm to thereafter be secured in place, each attachment assembly including a mounting bracket being permanently secured to the table.

15. A table and net mounting assembly as defined in claim 14, wherein a continuous joint is defined between the two table tops when the table is in the playing position, and wherein each extension arm is configured in a curvilinear shape such that each net post may be positioned in line with the continuous joint.

16. A table and net mounting assembly as defined in claim 14, wherein each mounting bracket includes a substantially flat plate upon which the corresponding net bracket may rotate in response to the lateral force.

17. A net mounting assembly as defined in claim 14, wherein each attachment comprises a pivot pin extending outwardly from the mounting bracket, and wherein each extension arm is configured with a slotted channel for slidably receiving the pivot pin.

18. A net mounting assembly as defined in claim 14, wherein each attachment assembly comprises a pair of retaining bracket configured to clamp the corresponding extension arm therebetween.

19. A table and net mounting assembly as defined in claim 14, wherein the two table tops define a lateral edge which extends along the length of each side of the table when the table is in the playing position, and wherein the extension arms are sufficiently long to permit the corresponding net posts to be positioned at least six inches beyond the lateral edge of the table.

20. A table and net mounting assembly as defined in claim 14, wherein the mounting brackets are permanently secured to the first table top.

21. A table and net mounting assembly as defined in claim 20, wherein table tops have a bottom surface and the mounting brackets are permanently secured to the bottom surface of the first table top.

22. A net mounting assembly as defined in claim 14, wherein each attachment assembly further comprises a threaded pivot pin and a wing nut threadably engaging the pivot pin.

23. A table and net mounting assembly for use in playing the game of table tennis, comprising:

a first and a second table top, the table tops being pivotally mounted for movement between a storage position in which the table tops are positioned in a substantially vertical disposition, and a playing position in which the table tops are positioned contiguous to each other in a substantially horizontal disposition;

a pair of net brackets, each net bracket comprising,
a net post to which the net may be secured, and
an arm mounted to the net post; and an attachment assembly for attaching each arm to the table, the attachment assembly including a mounting bracket which provides sole means of attachment of each net bracket to the table, each mounting bracket permanently secured to only the first table top.

24. A table and net mounting assembly as defined in claim 23, wherein each attachment assembly is configured to secure the corresponding net bracket while permitting the net bracket to pivot relative to the table in response to a sufficient lateral force applied to the net bracket, thereby preventing the lateral force from damaging the net mounting assembly.

25. A table and net mounting assembly as defined in claim 24, wherein each mounting bracket includes a substantially flat plate upon which the corresponding net bracket may rotate in response to the lateral force.

26. A table and net mounting assembly as defined in claim 23, wherein the arm on each net bracket comprises an extension arm and wherein each attachment assembly is configured to slidably engage the corresponding extension arm.

27. A table and net mounting assembly as defined in claim 26, wherein each attachment assembly comprises a pivot pin extending outwardly from the mounting brace, and wherein each extension arm is configured with a slotted channel for slidably receiving the pivot pin.

28. A table and net mounting assembly as defined in claim 26, wherein each attachment assembly comprises a pair of retaining bracket configured to clamp the corresponding extension arm therebetween.

29. A table and net mounting assembly as defined in claim 23, wherein a continuous joint is defined between the two table tops when the table is in the playing position, and wherein each extension arm is configured in a curvilinear shape such that each net post may be positioned in line with the continuous joint.

30. A table and net mounting assembly as defined in claim 23, wherein the two table tops define a lateral edge which extends along the length of each side of the table when the table is in the playing position, and wherein the extension arms are sufficiently long to permit the corresponding net posts to be positioned at least six inches beyond the lateral edge of the table.

* * * * *

UNITED STATES PATENT AND TRADEMARK OFFICE

CERTIFICATE OF CORRECTION

PATENT NO. : 5,769,744
DATED : June 23, 1998
INVENTOR(S) : Merrill et al.

It is certified that error appears in the above-identified patent and that said Letters Patent is hereby corrected as shown below:

column 1, line 45, please delete "be" (first occurrence)
column 7, line 2, please delete "in" and insert therefor - -to- -.
column 8, line 28, please delete "paallel" and insert therefor -- parallel --.
column 8, line 37, please delete "and" and insert therefor - -arm- -.
column 8 line 53, please add "assembly" after the word attachment.
column 8, line 59, please delete "bracket" and insert therefor --brackets --.
column 10 line 12, please delete "brace" and insert therefor - -bracket- -.
column 10, line 17, please delete "bracket" and insert therefor --brackets --.

Signed and Sealed this

Eighth Day of September, 1998

*Attest:*

Bruce Lehman

BRUCE LEHMAN

*Attesting Officer*

*Commissioner of Patents and Trademarks*